US007299602B2

(12) United States Patent
Denom et al.

(10) Patent No.: US 7,299,602 B2
(45) Date of Patent: Nov. 27, 2007

(54) DEVICE FOR SCREWING AND CRIMPING A CAP ON A NECK

(75) Inventors: Guy Denom, Saint Seurin sur l'Isle (FR); Jean-Marie Bourreau, Le Pizou (FR)

(73) Assignee: Pechiney Capsules, Clichy (FR)

( * ) Notice: Subject to any disclaimer, the term of this patent is extended or adjusted under 35 U.S.C. 154(b) by 100 days.

(21) Appl. No.: 10/518,379

(22) PCT Filed: Jul. 1, 2003

(86) PCT No.: PCT/FR03/02030

§ 371 (c)(1),
(2), (4) Date: Feb. 8, 2005

(87) PCT Pub. No.: WO2004/005181

PCT Pub. Date: Jan. 15, 2004

(65) Prior Publication Data

US 2005/0204710 A1 Sep. 22, 2005

(30) Foreign Application Priority Data

Jul. 4, 2002 (FR) ..... 02 08383

(51) Int. Cl.
*B67B 3/20* (2006.01)
*B65B 7/28* (2006.01)

(52) U.S. Cl. ..... 53/331; 53/331.5; 53/287

(58) Field of Classification Search ..... 53/484, 53/485, 488, 490, 287, 329, 329.3, 331.5, 53/331
See application file for complete search history.

(56) References Cited

U.S. PATENT DOCUMENTS

| | | | | |
|---|---|---|---|---|
| 2,995,882 | A * | 8/1961 | Barnby | 53/284.6 |
| 3,076,300 | A * | 2/1963 | Luedi et al. | 53/331 |
| 3,151,426 | A | 10/1964 | Pechmann | |
| 3,224,164 | A * | 12/1965 | Keller et al. | 53/331 |
| 3,645,062 | A * | 2/1972 | Hannon | 53/412 |
| 3,760,561 | A * | 9/1973 | Over et al. | 53/201 |
| 4,075,820 | A * | 2/1978 | Standley | 53/329.4 |
| 4,291,813 | A | 9/1981 | Allen et al. | |
| 4,466,548 | A * | 8/1984 | Herbert | 215/307 |
| 5,584,161 | A * | 12/1996 | Zanini et al. | 53/317 |
| 5,687,552 | A * | 11/1997 | Barca | 53/490 |
| 6,679,026 | B1 * | 1/2004 | Cirio | 53/317 |
| 6,948,297 | B2 * | 9/2005 | Kitamoto | 53/490 |

* cited by examiner

*Primary Examiner*—Rinaldi I. Rada
*Assistant Examiner*—Paul Durand
(74) *Attorney, Agent, or Firm*—Dennison, Schultz & Macdonald

(57) ABSTRACT

A device including a rotating capping head with axial displacement, characterized in that the head is provided with means for screwing a cap on the neck, and means for crimping the cap beneath a crimping ring. The axial displacement includes a first axial displacement of the head activating the screwing means and a second axial displacement of the head activating the crimping means, so as to produce successively, and in one single axial displacement of the head, a screwing step and a crimping step constituting the capping process. The inventive device enables the cap to be screwed and crimped in one single step.

13 Claims, 7 Drawing Sheets

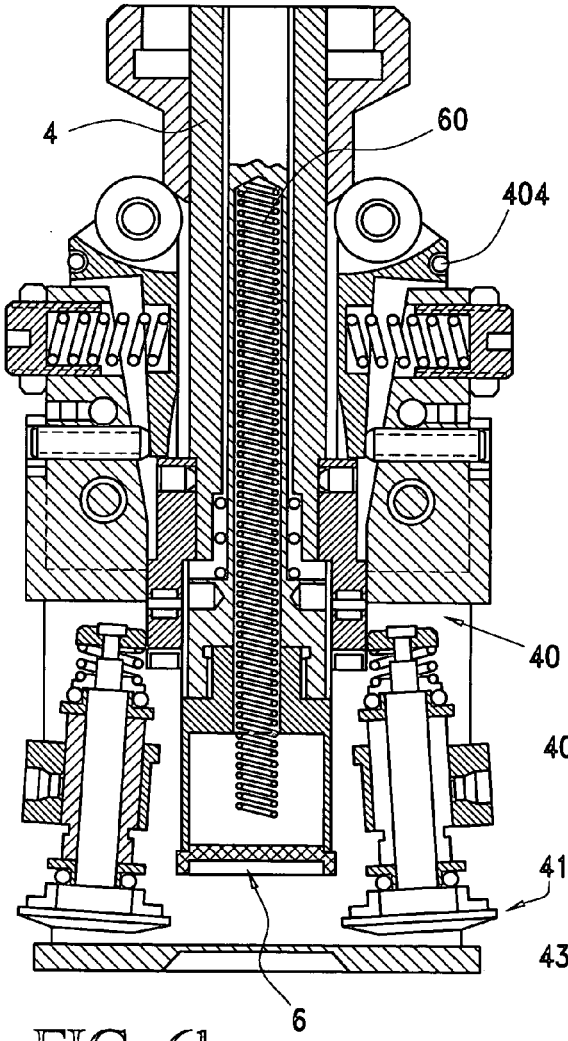
FIG. 6b
FIG. 6a
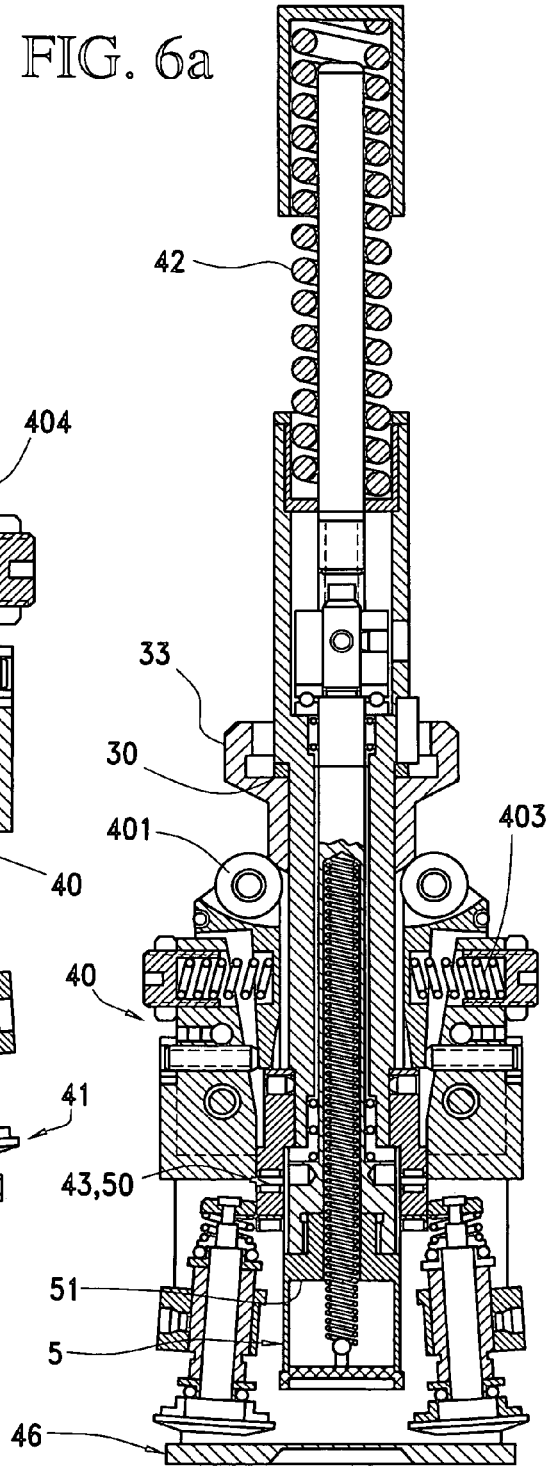

DEVICE FOR SCREWING AND CRIMPING A CAP ON A NECK

This application is a filing under 35 USC 371 of PCT/FR2003/002030 filed Jul. 1, 2003.

FIELD OF THE INVENTION

The invention relates to the domain of capping of receptacles, particularly bottles, and typically screwing and crimping screw sealing caps on bottles with threaded necks.

DESCRIPTION OF THE RELATED ART

Caps are usually crimped using a capping head with mobile wheels that operates according to the principle described in French patent No. 978 537.

The essential elements of the crimping head include particularly:

- a spring ejector provided with a profiled end piece with axial displacement due to a slide fixed to the frame of the capping machine,
- a rotating ring (rotated by means not shown) with a slide as hub and on which rods are fixed, the end of each rod being fitted with a wheel free to rotate axially,
- springs acting on the set of rods such that the wheels apply a radial pressure on the cap while actually crimping, or on the profiled end piece during the crimping cycle phase,
- guide means.

When crimping an outer cap, the rotating ring, the rods and the wheels are all rotating, and while the end piece presses on the head of the cap, there is a relative displacement (axial) of the rotating ring, rods and wheels with respect to the assembly formed by the ejector and the skirt of the cap: gradually, the wheels that were initially bearing on the profiled end piece come into contact and bear on the skirt of the cap and crimp it.

The inventors have already improved existing crimping heads several times, firstly by modifying the profile of the wheels as described in French patent No. 2 469 379, and also by varying the hardness of the wheels, as described in French patent No. 2 675 495, and finally by varying the number and configuration of the wheels as described in French patent No. 2 710 905.

Screwing heads are also known.

Up to now, bottles with threaded necks with a metallic screw cap were sealed in two passes or two steps, with two different items of equipment:

- a cap screwing step using a screwing head,
- then a crimping step using a crimping head.

This invention is intended to perform the two screwing and crimping operations in a single step and with a single item of equipment, so as to reduce the capping investment, in other words the cost of capping equipment or devices, to reduce the capping time, and to reduce the size of capping equipment.

Consequently, the inventors have developed a device for performing a complete screwing and crimping operation on the sealing cap, in a single pass.

SUMMARY OF THE INVENTION

According to the invention, the capping device for a neck of a receptacle with an axis of symmetry, typically a bottle, comprising an upper threaded portion with height Hf provided with at least one thread with N turns and a lower portion or crimping ring, using a screw sealing cap provided with a head and a crimpable skirt, typically metallic, comprises a capping head capable of rotating at a rotation speed Ω using a rotation means, about an axis of rotation with the said axis of symmetry, and with axial displacement so as to move the said head closer to the said neck typically fixed in the axial direction, during the said capping operation due to an axial displacement means, and is characterised in that the said head is provided with a means of screwing the said cap to the said upper threaded portion of the said neck, and a means of crimping the said skirt under the said crimping ring, the said axial displacement comprising a first axial displacement of the said head activating the said screwing means and a second axial displacement of the said head activating the said crimping means, so as to have firstly a screwing step and secondly a crimping step forming the said capping operation, or in a single axial displacement of the said head.

Thus, with the device according to the invention, a single axial displacement of the head is sufficient to successively screw and then to crimp the cap which solves the problems that arise since a single head is sufficient where two heads and two distinct items of equipment were necessary using standard equipment according to the state of the art.

BRIEF DESCRIPTION OF THE DRAWINGS

All the figures relate to the invention.

FIGS. 1 to 6*b* show diagrammatic views or sections through a vertical plane passing through the axis of rotation (20) of the capping head (2) and the axis of symmetry (71) of the neck (70) to be sealed.

FIG. 1 is a diagrammatic view of the capping device (1).

FIGS. 2 to 5 are left half-views of the capping head (2) during the different cap fitting phases, as the head (2) is lowered with respect of the neck (70) to be sealed:

FIG. 2 shows the head (2) before the beginning of screwing of the sealing cap (8) on the neck (70), FIG. 3 shows the head (2) at the end of screwing of the cap (8), but before compression of the seal (81) in the cap, FIG. 4 shows the head (2) after compression of the seal (81) and the beginning of tipping of the crimping arm (40), FIG. 5 shows the head (2) at the end of crimping.

FIGS. 6*a* and 6*b* relate to the head that was made, FIG. 6*a* being a view of the major part of the head (2), while FIG. 6*b* is an enlarged view of the lower part of the head.

FIG. 7*a* shows displacements (ordinate) of the different parts of the head during a single cycle (abscissa), namely as the head is lowered and then lifted once.

FIG. 7*b* diagrammatically shows several cycles (3 cycles) composed of linear portions, while in FIG. 7*c* the head displacement is sinusoidal.

DETAILED DESCRIPTION OF THE INVENTION

According to the invention, during the said first displacement, the said screwing means can rotate the said cap (8) with respect to the said neck (70) with a rotation speed of the said cap (8) typically close to the said rotation speed Ω of the said head (2).

As soon as the bearing part (6) comes into contact with the cap to be screwed, it drives it in rotation at speed Ω.

Figure 2:
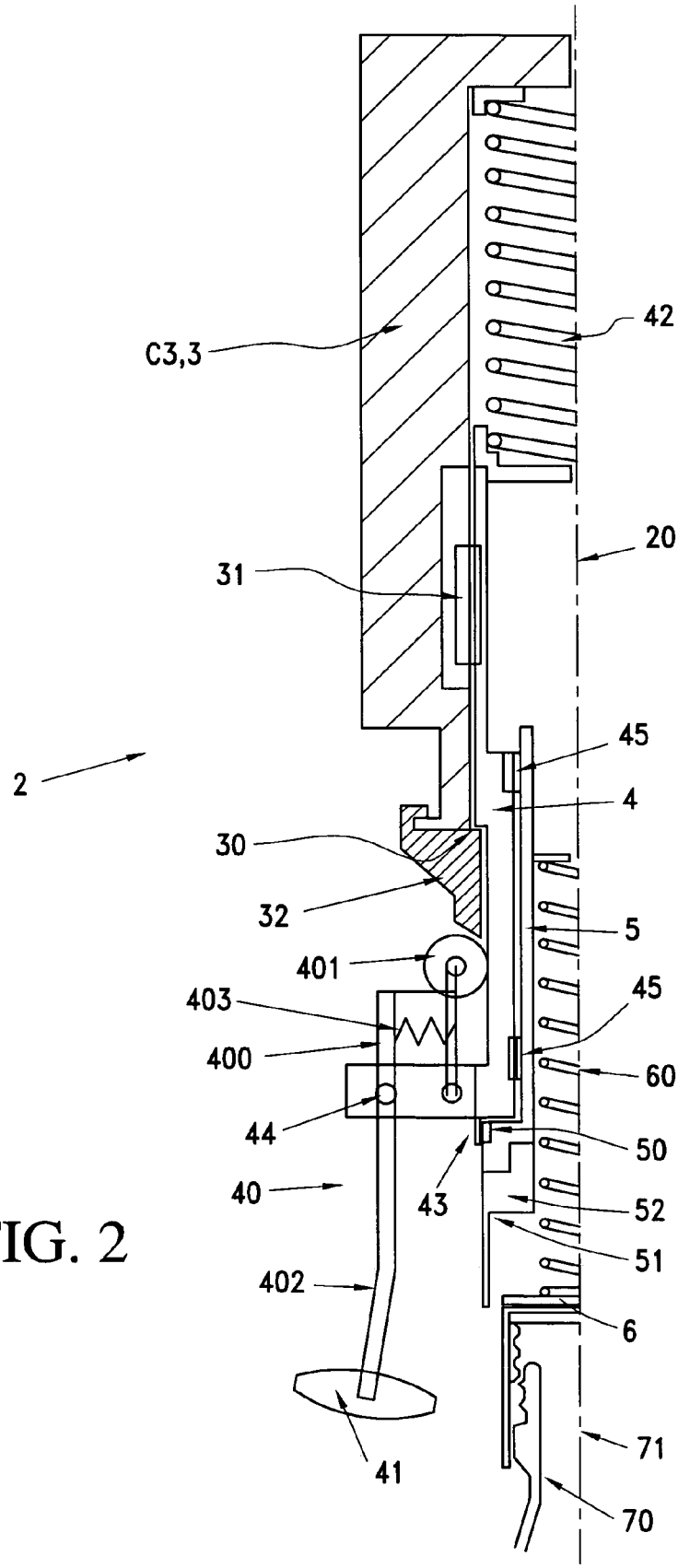
Figure 3:
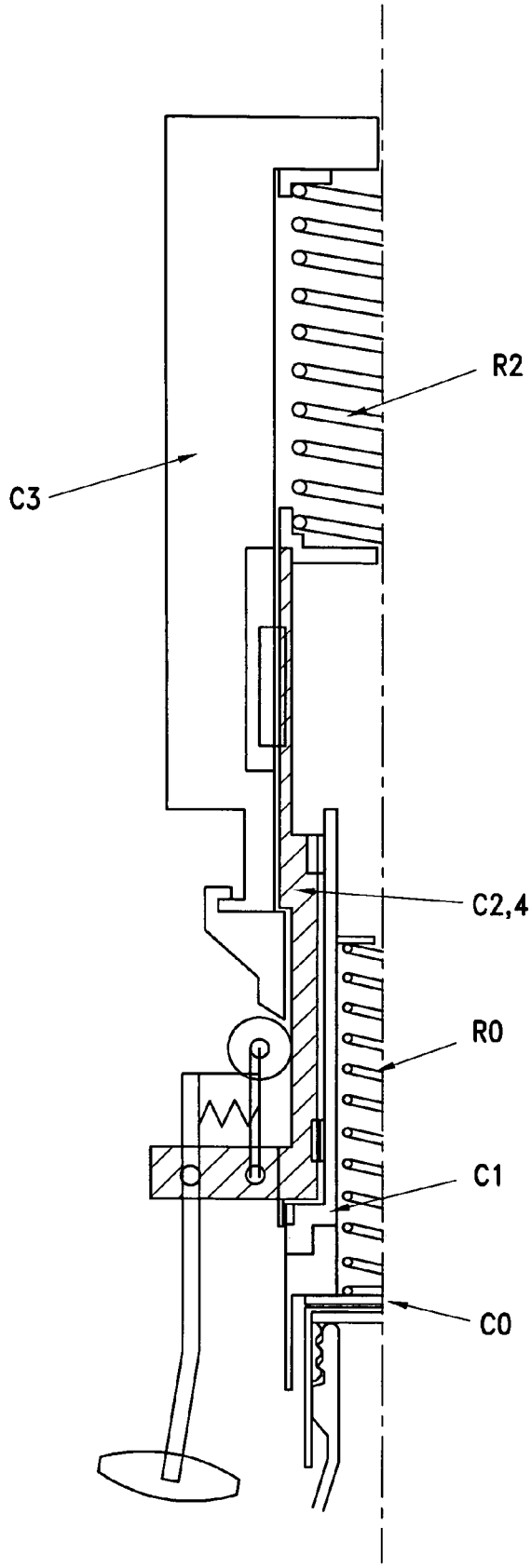

This contact may correspond to a predetermined axial force and, as illustrated particularly in FIGS. 2 and 3, to achieve this the said screwing means may comprise a means, typically a spring R0 (60) applying a force F0 on the said head (82) of the said cap (8) typically varying from 20 N to 150 N, during all or some of the said screwing step.

According to the invention, the said crimping means may include at least two arms or lifting beams (40), each arm (40) carrying a crimping roller (41) at its lower end, articulated so that it can be brought closer to the said neck (70) during the said crimping step and moved away from the said neck (70) during the said screwing step.

Figure 4:
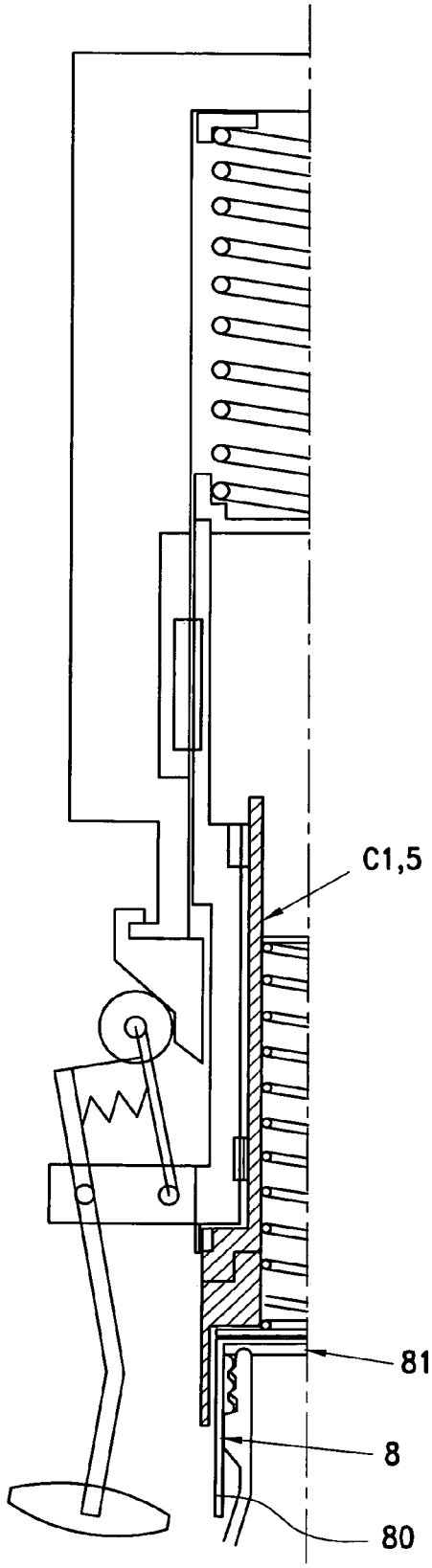
Figure 5:
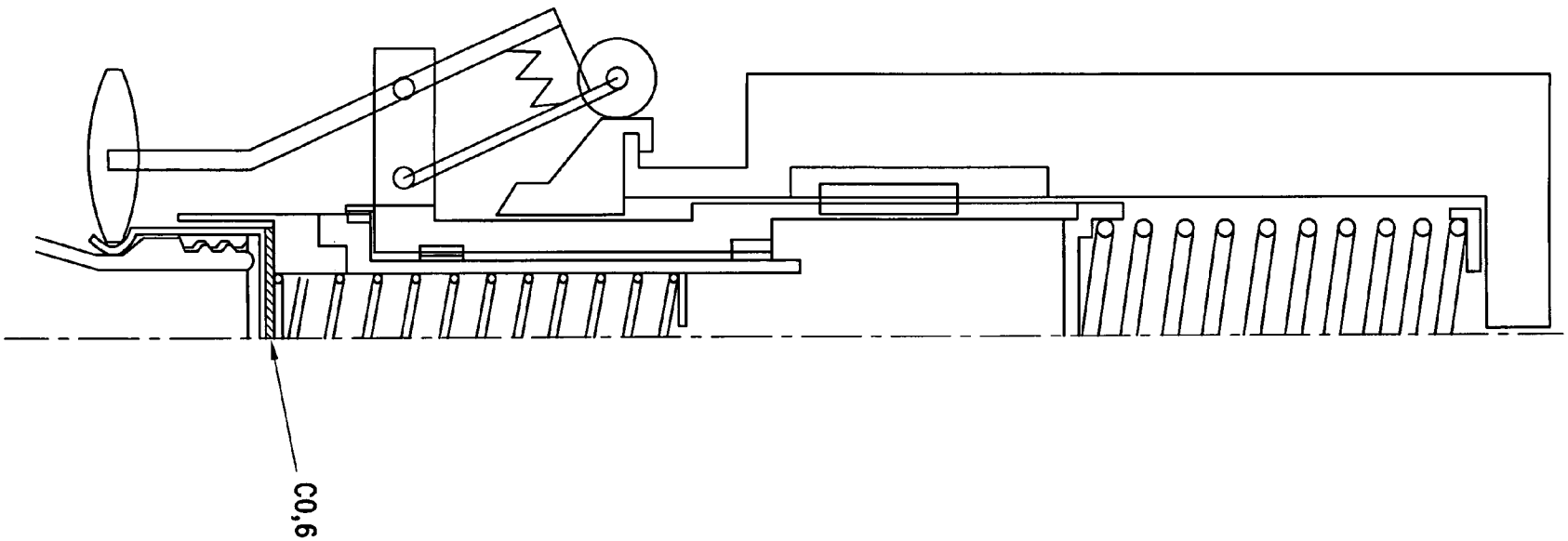

As shown particularly in FIGS. 3 to 5, the said head (2) may include a means, typically a spring R2 (42) for applying a force F2 on the said head (82) of the said cap (8), typically varying from 500 N to 1500 N after the said screwing step and during all or some of the said crimping step.

As can be seen in FIG. 4, the said means for applying the said force F2 may typically be activated before the said rollers (41) are applied in contact with the said skirt in order to crimp the said skirt (80), so as to axially compress the said cap (8) in contact with the said neck (70) and its sealing ring, particularly when the said cap (8) comprises a compressible seal (81) to be compressed before the crimping step in order to seal the said cap (8) on the said neck (70).

According to one embodiment of the invention, the said head (2) may comprise:

a) a support C3 (3), typically cylindrical, solidarised to a fixed frame (10), capable of turning about the said axis of rotation (20) with the said rotation speed Ω typically predetermined and possibly constant, and moving in the axial direction with respect to the said neck (70) with an axial displacement D3, b) a coaxial tubular body C2 (4) internal to the said support C3 (3), but capable of moving axially with respect to the said support C3 (3) with an axial displacement D2, the said support C3 (3) comprising a lower stop (30) to limit the axial displacement of the said tubular body C2 (4) and applying a force F2 on the said tubular body C2 (4), typically using a spring R2 (42), c) a central body C1 (5), coaxial with the said tubular body C2 (4), typically hollow, solidarised to the said tubular body C2 (4) for the said displacement D2 typically by means of a set of bearings, typically needle bearings (45), the said tubular body C2 (4) forming a hub for the said central body C1 (5) acting as an axle, d) a means for partial coupling of the said tubular body C2 (4) and the said central body C1 (5) in rotation, rotation of the said tubular body C2 (4) only causing a rotation of the said central body C1 (5) during the said screwing step, rotation of the said central body C1 (5) possibly being interrupted by the development of an opposing torque C at the end of screwing, e) the said central body C1 (5) comprises a bearing part C0 (6) that will cause rotation of the said cap (8) and move axially with respect to the said central body C1 (5) with a displacement D0 typically corresponding to the height of the said threaded portion (700) of the said cap (8), an upper stop (51) for the said bearing part (6) and a spring R0 (60) applying a force F0 on the said bearing part C0 (6) so as to provide coupling of the said head (2) through the said bearing part C0 (6) and the said cap (8) in rotation, and to form the said screwing means, f) the said arms or lifting beams (40) of the said crimping means are axially fixed to the said tubular body C2 (4) and can be rotated due to a secondary rotation axis (44) typically fixed to the said tubular body C2(4).

The said crimping means may include a cam (32) axially fixed to the said support C3 (3), each of the said typically rigid arms (40) comprising an upper part (400) typically provided with a caster or a wheel or a sliding pad (401), and a roller support arm (402) supporting the said roller (41), such that the said second displacement causes a temporary cooperation of the said cam (32) and the said wheel or pad (401), bringing the said roller (41) closer to the said neck (70) for said crimping.

Figure 1:
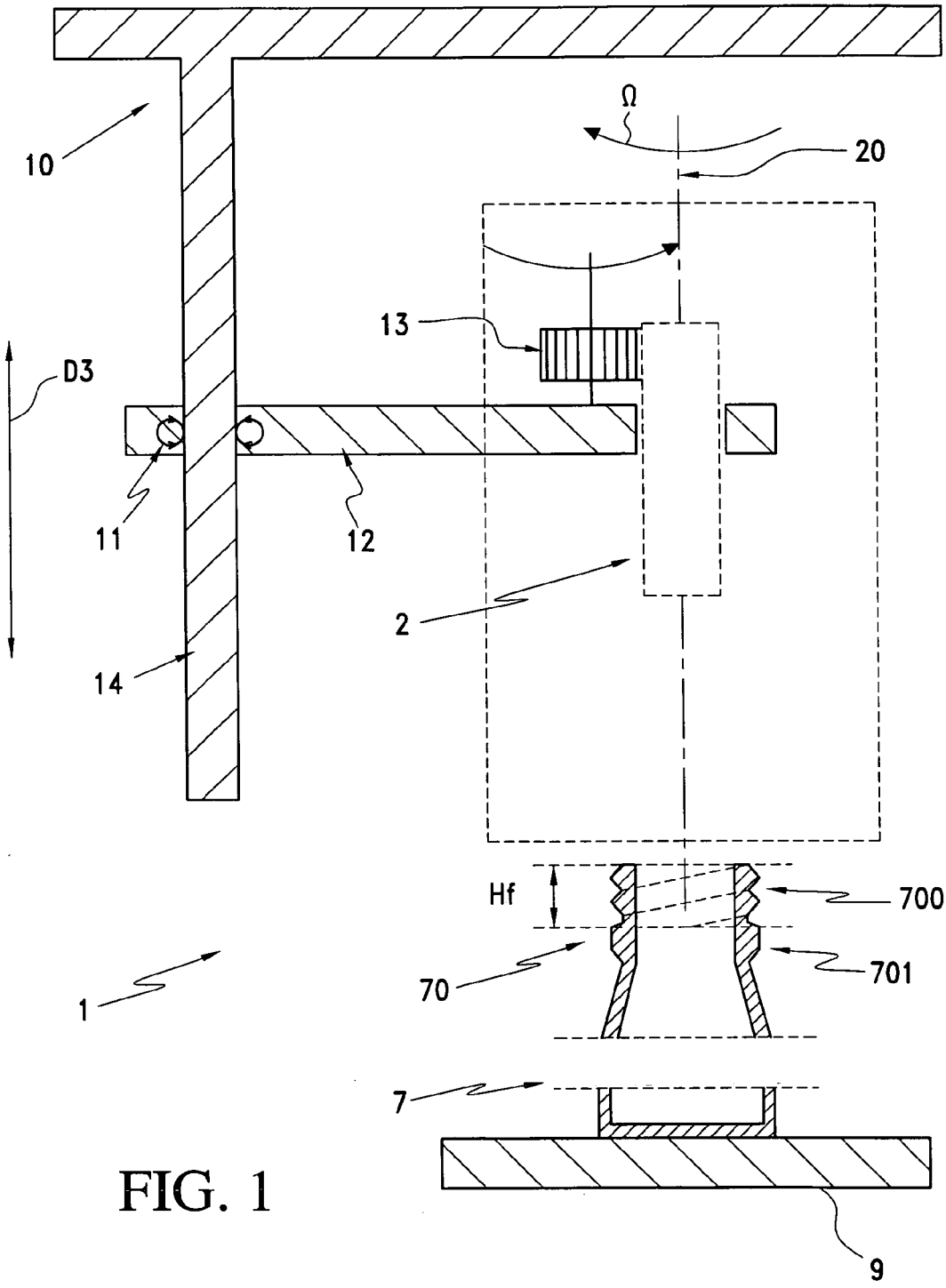

According to one embodiment of the invention illustrated diagrammatically in FIG. 1, the said support C3 (3) of the said head (2) may be solidarised to an arm (12), typically horizontal, and is free in rotation with respect to the said arm (12), the said support C3 (3) and the said arm (12) respectively forming an axle/hub assembly, the said arm (12) possibly acting as a support for a motor forming the said rotation means (13) capable of driving the said support C3 (3) in rotation.

The said arm (12) and the said fixed frame (10) may cooperate, typically using a vertical column (14) so as to assure the said axial displacement D3 of the support C3 (3) by translation of the said arm (12) in a vertical plane, typically by means of an auxiliary motor (11) acting as an axial displacement means.

But according to another embodiment of the invention (not shown in any figure), the said arm (12) may be placed onboard a rotary turret and form part of a set of n capping heads (2), where n typically varies from 2 to 12, the supports C3 (3) being engaged to a central gearwheel to rotate the said supports C3.

According to the invention, the said partial rotational coupling means of the said tubular body C2 (4) and the said central body C1 (5) may be a magnetic or electromagnetic coupling, typically by means of facing magnets (43, 50) supported by the said tubular body C2 (4) and the said central body C1 (5). These facing magnets are typically chosen such that the torque applied on the cap is equal to not more than 80% of the value of the limiting torque corresponding to irreversible deformation or destruction of the cap.

It is advantageous if at the end of the screwing step, the said bearing part C0 (6) is capable of coming into contact and stopping in contact with the said upper stop (51) so that the said central body C1 (5) and the said tubular body C2 (4) can transmit the said force F2 to the head (82) of the said cap (8).

The rotation speed Ω and displacement speed V of the said head (2) during the said first displacement may be slaved so as to satisfy the relation $V=Hf.\Omega/N$ so as to synchronise rotation of the said cap (8) and the lowering speed onto the neck (70) during the said screwing step, typical values of Hf, Ω and N being 5 mm to 20 mm for Hf, 150 rpm to 500 rpm for Ω, 0.5 to 5 for N, with the total number of rotations varying from 10 to 25. Thus, there is no risk of deformation of the threads of the caps.

Another purpose of the invention is a method of capping a bottle using the capping device (1) according to the invention using a capping head (2) screwing and crimping a screw cap (8) on the threaded neck (70) of the said bottle or receptacle (7) and in which the said bottle (7) having firstly being brought facing the said head, typically by horizontal step by step displacement, or possibly continuous displacement, the said bottle (7) and alignment of the said rotation axis (20) and the axis of symmetry (71) and held still for a time T corresponding to one capping cycle, the said head is subjected to a cyclic movement with duration T with respect to the said neck (70) typically including lowering of the said head from a high point to a low point, with a lowering time Td of the said head during which the said cap was firstly procured and placed on the said neck, the said screwing is carried out first during a time Tdv followed by the said crimping for a time Tds, the said lowering time Td being approximately equal to the time necessary to perform the said first and second displacements, followed by a rise time Tr of the said head, the said bottle after being capped being displaced and replaced by another bottle to be capped typically when the said head is at the said high point.

Figure 7A:
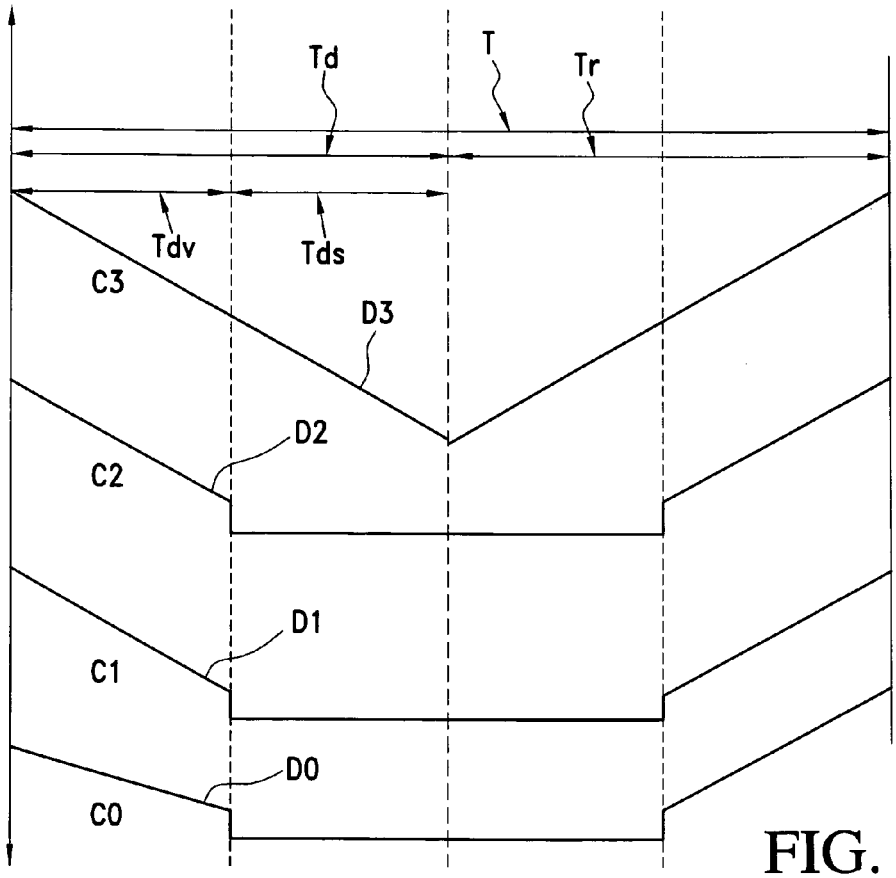
FIGS. 7*a* to 7*c* show diagrams related to axial displacements of the head or its different parts.

FIG. 7*a* diagrammatically illustrates the different displacements (ordinates) as a function of time during a cycle T (abscissa).

Figure 7B:
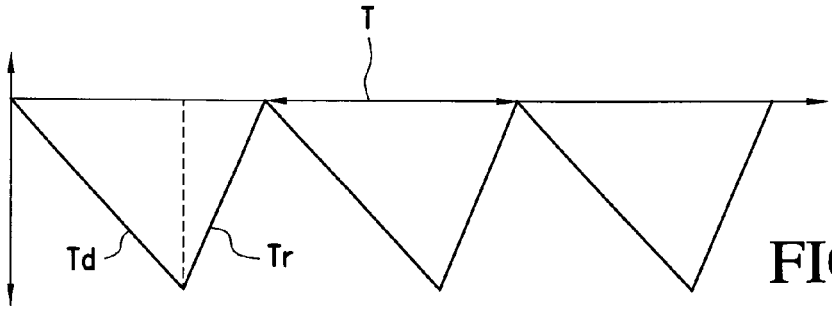
Figure 7C:
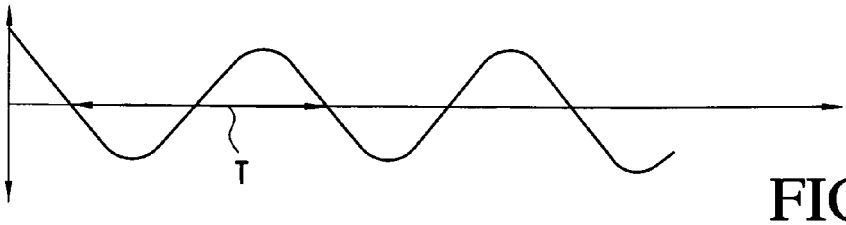

In this process, the said cyclic movement of the said head (2) may be a sinusoidal movement typically obtained by cooperation of a connecting rod and a crank, as illustrated in FIG. 7*c*. It may possibly be a continuous circular movement typically obtained using a cam.

The said cyclic movement of the said head may be a movement composed of linear parts at constant speed, typically obtained with hydraulic jacks as illustrated in FIG. 7*b*. In this case, the rising time Tr may be shorter than the lowering time Td, and typically less than half as long.

Example Embodiment

FIGS. 6*a* and 6*b* form an example embodiment of a head (2) according to the invention, FIGS. 2 to 5 being more diagrammatic and intended to explain operation of the head (2) represented in FIGS. 5*a* and 6*b*.

Marks shown in FIG. 2 have not been repeated in FIGS. 3 to 5, to avoid making FIGS. 3 to 5 unnecessarily more congested.

ADVANTAGES OF THE INVENTION

The invention can solve the problems that arise and perform the screwing and crimping operations in a single step and with a single item of equipment.

Furthermore, although the device according to the invention is slightly more expensive than a screwing device or a crimping device, is significantly less expensive than the combined investment cost of a screwing device and a crimping device. The same is true for the maintenance cost of the device according to the invention.

The inventors have also observed that the device according to the invention can increase production rates.

Finally, the device according to the invention halves the floor space occupied by separate screwing means and capping means.

LIST OF REFERENCES capping device . . . 1
- Fixed frame . . . 10
- Axial displacement means (aux. motor) . . . 11
- Horizontal arm . . . 12
- Means of rotation (motor) of 2 . . . 13
- Vertical column . . . 14

Capping head . . . 2
- Rotation axis . . . 20

Support C3 . . . 3
- Lower stop . . . 30
- Coupling of 3 and 4 in rotation . . . 31
- Cam cooperating with 401 . . . 32

Tubular body C2 . . . 4
- Arms or lifting beams . . . 40
  - Upper part . . . 400
  - Wheel or pad . . . 401
  - Roller support arm . . . 402
  - Crimping spring . . . 403
  - Arm return spring 40 . . . 404
- Crimping roller . . . 41
- Spring R2 . . . 42
- Partial coupling in rotation (magnets) . . . 43
- Secondary rotation axis . . . 44
- (Needle) bearings between 4 and 5 . . . 45
- Centring device . . . 46

Central body C1 . . . 5
- Partial coupling in rotation (magnets) . . . 50
- Upper stop . . . 51
- End piece adaptable to the neck . . . 52

Bearing part C0 . . . 6
- Spring R0 . . . 60

Bottle, receptacle . . . 7
- Neck . . . 70
  - Threaded upper portion . . . 700
  - Lower portion or ring . . . 701
- Axis of symmetry . . . 71

Sealing cap . . . 8
- Crimpable skirt . . . 80
- Compressible seal . . . 81
- Head . . . 82

Bottle, receptacle support . . . 9

The invention claimed is:

1. Capping device for screwing a prethreaded sealing cap onto a neck of a receptacle with an axis of symmetry, the neck having a threaded upper portion with height Hf provided with at least one thread with N turns and a lower portion with crimping ring, the sealing cap including a head and a metallic crimpable skirt, the device comprising:

a capping head;

rotating means for rotating the capping head at a rotation speed Ω about an axis of rotation common with the axis of symmetry; and axial displacement means for moving the capping head axially closer to and away from the neck which is fixed in axial position during a capping operation;

the capping head comprising:

a bearing head constructed and arranged to retain the cap during screwing and crimping operations, the bearing head being selectively coupled to the capping head for rotation and axial displacement;

resilient means for applying a force varying from 20 to 150 N on the cap through the bearing head during at least a part of the rotating of the capping head;

means for decoupling the bearing head from rotation of the capping head when torque on the bearing head increases beyond a predetermined level, and means for decoupling the bearing head from axial displacement of the capping head when axial displacement of the cap terminates by blocking of further rotation of the cap by the neck of the receptacle, thereby terminating rotation and axial displacement of the bearing head;

means for crimping the skirt under the crimping ring, and means for coupling the axial displacement means to the crimping means upon termination of rotation and axial movement of the bearing head, thereby activating the crimping means crimp the skirt under the crimping ring, wherein the capping device utilizes a capping operation comprised of a rotating step and a crimping step in a single axial displacement of the capping head.

2. Device according to claim 1, wherein the bearing head rotates the cap with a rotation speed close to the rotation speed Ω of the capping head.

3. Device according to claim 1, wherein the crimping means includes at least two arms, each said arm carrying a crimping roller at a lower end thereof, articulated so that it can be brought closer to the neck during the crimping step and moved away from the neck during the screwing step.

4. Device according to claim 3, wherein the capping head comprises:

a) a support fixed to a fixed frame, constructed and arranged for turning about the axis of rotation with the rotation speed Ω predetermined and optionally constant, and constructed and arranged for moving in the axial direction with respect to the neck with an axial displacement, b) a coaxial tubular body internal to the support and coaxial therewith, constructed and arranged for moving axially with respect to the support with an axial displacement, the support comprising a lower stop to limit the axial displacement of the tubular body and applying a force F2 on the tubular body using a spring means, c) a central body, coaxial with the tubular body and fixed to the tubular body for the displacement, the tubular body forming a hub for the central body acting as an axle, d) a means for selectively coupling the tubular body and the central body C1 in rotation, rotation of the tubular body only causing a rotation of the central body during the screwing step, rotation of the central body optionally being interrupted by the development of an opposing torque at the end of screwing, e) the central body comprising a bearing part that will cause rotation of the cap and move axially with respect to the central body with a displacement corresponding to the height of the threaded portion of the cap, an upper stop for the bearing part and a spring means applying the force F0 on the bearing part to provide coupling of the capping head through the bearing part and the cap in rotation, and to form the screwing means, f) the arms or lifting beams of the crimping means axially fixed to the tubular body and rotatable on a secondary rotation axis fixed to the tubular body.

5. Device according to claim 4, wherein the crimping means includes a cam axially fixed to the support, each of the rigid arms comprising an upper part provided with a caster or a wheel or a sliding pad, and a roller support arm supporting the roller, such that the second displacement causes a temporary cooperation of the cam and the wheel or pad, bringing the roller closer to the neck for the crimping.

6. Device according to claim 4, wherein the support of the capping head is fixed to an arm, and is free in rotation with respect to the arm, the support and the arm respectively forming an axle/hub assembly, the arm optionally acting as a support for a motor forming the rotation means capable of driving the support in rotation.

7. Device according to claim 6, wherein the arm and the fixed frame cooperate using a vertical column to assure the axial displacement of the support by translation of the arm in a vertical plane by means of an auxiliary motor acting as an axial displacement means.

8. Device according to claim 6, wherein the arm is placed onboard a rotary turret and forms part of a set of n capping heads, where n varies from 2 to 12, the supports being engaged to a central gearwheel to rotate the supports.

9. Device according to claim 4, wherein the means for selectively coupling comprises a magnetic or electromagnetic coupling.

10. Device according to claim 4, wherein, at the end of the screwing step, the bearing part is movable into contact with the upper stop so that the central body and the tubular body can transmit the force F2 to the cap.

11. Device according to claim 1, wherein the capping head additionally comprises a second resilient means for applying an axial force to compress the cap to the neck, upon termination of the screwing and during at least a part of the activation of the crimping means.

12. Device according to claim 11, wherein the axial force varies from 500 N to 1500 N.

13. Device according to claim 1, wherein the rotation speed Ω and displacement speed of the capping head during initial displacement are slaved to satisfy a relation $V=Hf.\Omega/N$, thereby synchronizing rotation of the cap and lowering the cap onto the neck during the screwing step, Hf being between 5 mm and 20 mm, Ω being between 150 rpm and 500 rpm and N being between 10 and 25 turns.

* * * * *